US011668461B2

(12) United States Patent
Haussner et al.

(10) Patent No.: US 11,668,461 B2
(45) Date of Patent: Jun. 6, 2023

(54) HEATING ROD FOR A GLOW PLUG AND METHOD FOR PRODUCING A HEATING ROD AND GLOW PLUG

(71) Applicant: BorgWarner Ludwigsburg GmbH, Ludwigsburg (DE)

(72) Inventors: Michael Haussner, Benningen (DE); Martin Allgaier, Ludwigsburg (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 561 days.

(21) Appl. No.: 16/377,808

(22) Filed: Apr. 8, 2019

(65) Prior Publication Data

US 2019/0309947 A1 Oct. 10, 2019

(30) Foreign Application Priority Data

Apr. 10, 2018 (DE) ..... 10 2018 108 427.7

(51) Int. Cl.
*F23Q 7/00* (2006.01)

(52) U.S. Cl.
CPC ..... *F23Q 7/001* (2013.01); *F23Q 2007/004* (2013.01)

(58) Field of Classification Search
CPC ..... F23Q 2007/004; F23Q 7/001
USPC ..... 219/260–270; 123/169 R
See application file for complete search history.

(56) References Cited

U.S. PATENT DOCUMENTS

| | | | | |
|---|---|---|---|---|
| 5,084,607 | A * | 1/1992 | Shafer | F23Q 7/001 361/266 |
| 7,829,824 | B2 | 11/2010 | Last | |
| 8,513,570 | B2 | 8/2013 | Haussner et al. | |
| 9,964,306 | B2 | 5/2018 | Hain et al. | |
| 2004/0182145 | A1* | 9/2004 | Okazaki | G01L 23/222 73/35.12 |
| 2007/0095811 | A1* | 5/2007 | Last | F23Q 7/001 219/270 |
| 2008/0264373 | A1* | 10/2008 | Boehland | F23Q 7/001 123/145 A |
| 2009/0321408 | A1* | 12/2009 | Kern | F23Q 7/001 219/270 |
| 2011/0215080 | A1* | 9/2011 | Hain | F23Q 7/001 219/270 |
| 2012/0067863 | A1* | 3/2012 | Suzuki | F23Q 7/001 219/270 |

(Continued)

FOREIGN PATENT DOCUMENTS

| | | |
|---|---|---|
| DE | 103 46 330 A1 | 5/2005 |
| DE | 10 2005 021 229 A1 | 11/2006 |

(Continued)

*Primary Examiner* — Jimmy Chou
*Assistant Examiner* — Ket D Dang
(74) *Attorney, Agent, or Firm* — Bose McKinney & Evans LLP

(57) ABSTRACT

This document describes a heating rod for a glow plug with a ceramic glow element having a glow tip at its front end and a connector portion at its rear end, a contact element making electrical contact with the connector portion of the glow element, and a sheath, from which the front end of the glow element protrudes. According to this disclosure, the contact element is pressed against the glow element under pre-tension. Furthermore, this document describes a method for producing such a heating rod and a glow plug with such a heating rod.

16 Claims, 3 Drawing Sheets

(56) References Cited

U.S. PATENT DOCUMENTS

2012/0160821 A1* 6/2012 Ratosa ..... F23Q 7/001
219/270

FOREIGN PATENT DOCUMENTS

| | | | |
|---|---|---|---|
| DE | 10 2009 056 057 | A1 | 6/2010 |
| DE | 10 2009 011 415 | A1 | 9/2010 |
| DE | 10 2013 211 713 | A1 | 12/2014 |
| DE | 10 2013 212 298 | A1 | 12/2014 |
| DE | 10 2013 215 269 | A1 | 2/2015 |
| DE | 10 2014 220 036 | A1 | 4/2016 |
| EP | 1 780 468 | A2 | 5/2007 |

* cited by examiner

Fig. 3
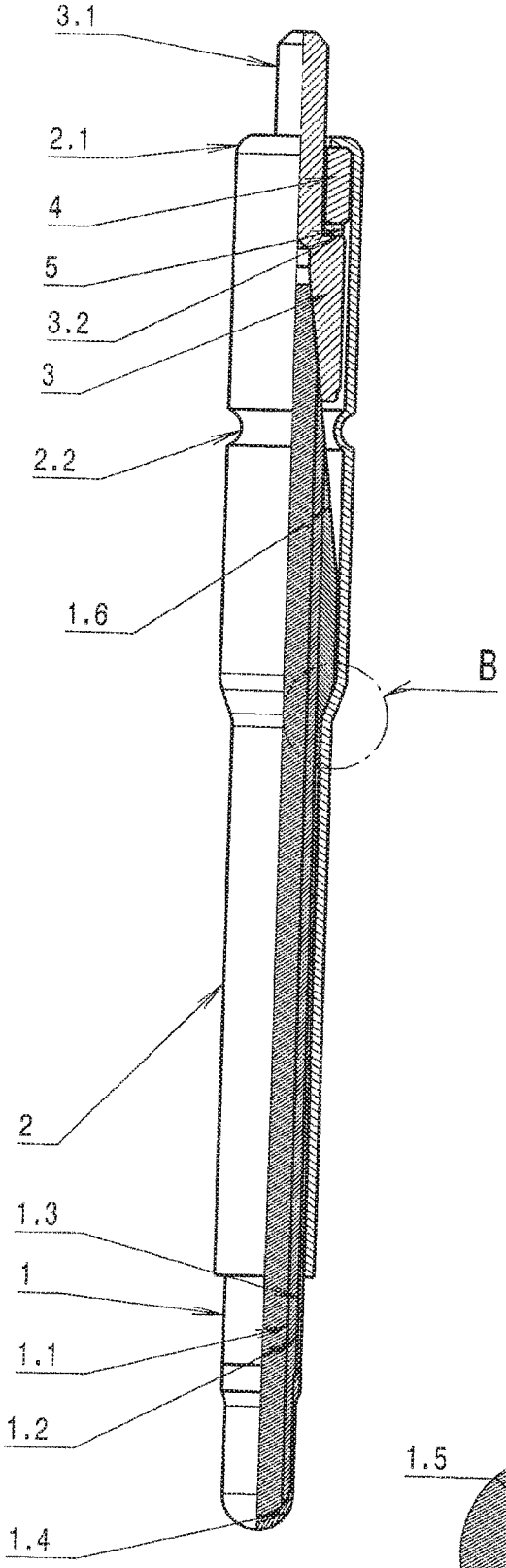
Fig. 4
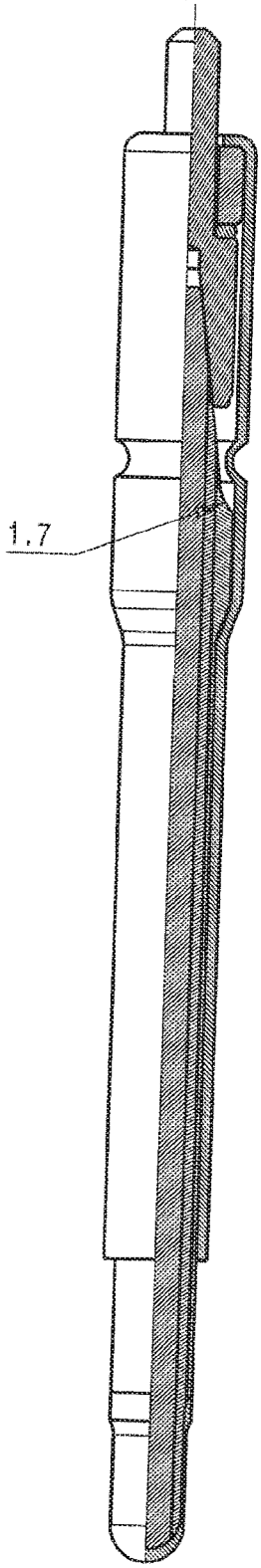
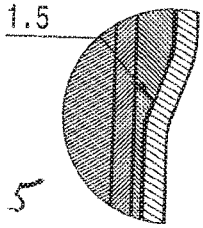
Fig. 5

HEATING ROD FOR A GLOW PLUG AND METHOD FOR PRODUCING A HEATING ROD AND GLOW PLUG

RELATED APPLICATIONS

This application claims priority to DE 10 2018 108 427.7, filed Apr. 10, 2018, the entire disclosure of which is hereby incorporated herein by reference.

This disclosure refers to a glow plug of the type having a heating rod that comprises a sheath and a ceramic glow element. A heating rod for a glow plug having a ceramic glow element with a glow tip at its front end and a connector portion at its rear end, a contact element, which electrically contacting the connector portion of the glow element, and a sheath, which protrudes from the front end of the glow element, is known from DE 10 2009 056 057 A1, for example.

In ceramic glow plugs, a sheath typically is used as a ground contact for the glow element and an interior conductor of the glow element is contacted electrically by a ring-shaped or sleeve-shaped contact element, for example, by inserting a tapered end section of the glow element into the contact element and soldering the connection. The precise axial alignment of the glow element and the soldering process require significant efforts in this case.

SUMMARY

This disclosure shows a way to simplify the production of a glow plug while at the same time achieving a precise axial alignment of the glow element.

In the inventive heating rod and, consequently, in the inventive glow plug, a reliable electrical contact between glow plug and contact element is achieved by pressing the contact element against the glow element under pre-tension, preferably under axial pre-tension. This way, the contact element and the glow element can be connected without soldering, which results in a significant simplification of the production process. In particular, this means that any axial misalignment of the glow element due to unevenly applied solder can be avoided.

The pre-tension can be created, for example, by first inserting the glow element into the sheath, then attaching the contact element to the glow element, for example, by pushing the contact element onto the glow element, and finally retracting (e.g., by bending the circumferential wall radially inwards) or beading the sheath at its rear end facing away from the glow tip, after which the sheath is compressed axially. It is preferable to compress the sheath axially while at least a section of the sheath is heated. Alternatively or additionally, the sheath, after having been retracted or beaded at its rear end, can be indented all the way around its circumference, for example by creating a ring groove. Axially compressing the sheath or radially indenting the same creates a tensile stress in the sheath, which is exerted in the longitudinal direction of the sheath. This tensile stress pushes the components arranged inside the sheath against each other, namely the contact element against the connector portion of the glow element.

One advantageous refinement of this disclosure provides for the glow element having a section that increases in diameter inside the sheath in the direction of the connector portion, thereby forming an end stop, by which the glow element is pressed against an interior surface of the sheath under pre-tension. The end stop can be in the shape of the tip of a truncated cone, for example. Preferably, the sheath has a front cylindrical section and a rear cylindrical section, with a transition section between these two, the interior surface of this transition section fitting closely to the bearing surface.

Preferably, the sheath is formed of a single piece and extends to a rear end of the heating rod, from which a connector for the inner pole of the glow plug may protrude, for example a pin that can be formed as a single piece together with the contact element. In this manner, the number of the components required for a heating rod and/or a glow plug can be reduced in an advantageous manner. But it is also possible to close off the sheath with a separate component at its rear end, for example with a welded-on tube section.

Another advantageous refinement of this disclosure provides for the press-fitting of the glow element into the sheath, such that the sheath forms a press-fit assembly with the glow element. Thus, the glow element is retained in the sheath securely and reliably, which is advantageous. For example, the glow element can be pressed into the sheath from the rear until an end stop of the glow element closely fits to a conical interior surface of the sheath. An annular gap may remain between a front section of the glow element and the sheath. In this case, the press-fit assembly is formed only by a rear section of the glow element and the sheath.

Another advantageous refinement of this disclosure provides for a tapering of the connector section of the glow element, for example a conical tapering, which is inserted into the contact element. The contact element can be formed as a ring or a sleeve in this context. It also is possible, for example, that the contact element has a conically shaped receptacle, into which the connector section of the glow element protrudes. The connector section of the glow element can be pressed into the contact element by longitudinal tension, thus creating contact pressure. If, given a conically tapered connector section and a correspondingly shaped contact element, the opening angle of the cone is sufficiently acute, contact pressure in a radial direction can be realized simply by the friction between the connector section of the glow element and the contact element.

Another advantageous refinement of this disclosure provides for a beading of the rear end of the sheath. This way, the number of components of the glow plug can be kept low, which is advantageous.

The glow element, the contact element and the sheath form a physical unit as a heating rod, which can be inserted into the metallic body of a glow plug. An inventive heating rod can be inserted into metallic bodies of various designs to create glow plugs according to the dimensions of various engines. An inventive heating rod can be used advantageously for glow plugs with and without a pressure measurement function.

In the context of this disclosure, the term "front" describes that end of the glow element, at which the glow tip is located, and the term "rear" describes the opposite end. In other components, such as the sheath, the term "front" correspondingly is used for the end closest to the glow tip and the term "rear" for the opposite end.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein:

FIG. 3 shows an embodiment of the heating rod of the glow plug of FIG. 1 in a partially sectional view;

FIG. 4 shows a partially sectional view of another embodiment of a heating rod for an inventive glow plug;

FIG. 5 shows a detailed view of the area indicated as B in FIG. 3;

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
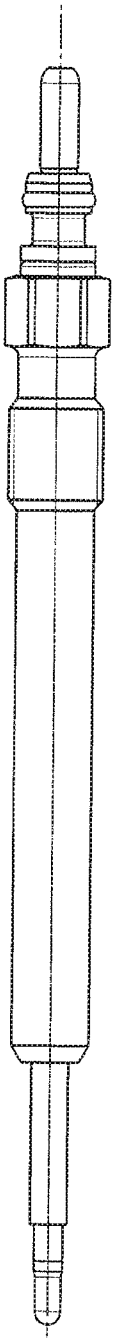
FIG. 1 is an elevational view of an embodiment of a glow plug.
Figure 2:
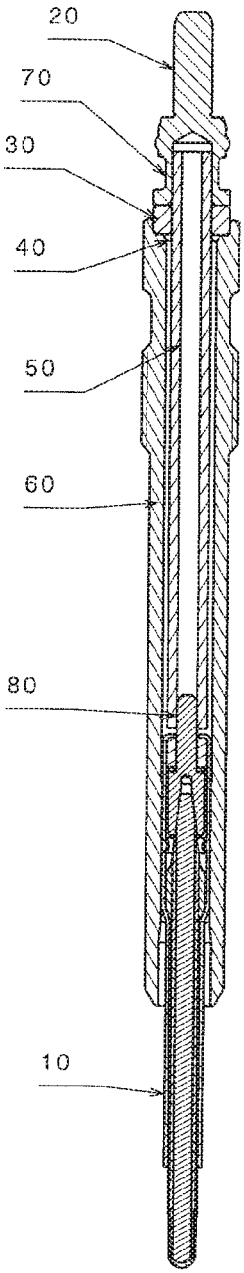
FIG. 2 is a cross-sectional view of the glow plug of FIG. 1.

FIG. 1 shows an embodiment of a glow plug. FIG. 2 shows a sectional view of the same glow plug, which includes a heating rod 10; a metallic body 60, from which the heating rod 10 protrudes; an inner pole 50 arranged inside the body 60 and connected to the heating rod 10; and an electrical connector 20, for example a connector plug, which is connected to the inner pole 50 in an electrically conducting manner. The inner pole 50 can be formed as a tube or a rod, for example, and can be electrically insulated from the body 60 via an insulating sleeve 30. A seal 40 can be provided for sealing the body 60, said seal 40 surrounding the inner pole 50 at the rear end of the body 60.

The connector 20 can be welded to the inner pole 50 at a joint 60. At its other end, the inner pole 50 can be electrically connected to the heating rod 10 at a joint 80, for example, by welding.

FIG. 3 shows a partially sectional view of an exemplary embodiment of the heating rod 10 of the glow plug shown in FIGS. 1 and 2. The heating rod has a ceramic glow element 1, which is shaped as a pin and retained in a sheath 2 and which is in electrical contact with a contact element 3 inside the sheath 2. The glow element 1 protrudes from the front end of the sheath 2 and has a glow tip at its front end.

The glow element 1 has an electrically conductive core 1.1, an insulating layer 1.2, which surrounds the core 1.1, and an outer conductor 1.3, which surrounds the insulating layer 1.2. The outer conductor 1.3 and the core 1.1 are connected in an electrically conducting manner at the front end of the glow element 1 by a surface layer 1.4, which forms the glow tip.

At its rear end, the glow element 1 has a tapered connector portion 1.6, for example a conically shaped connector portion. The connector portion 1.6 is inserted in the contact element 3, such that the contact element 3 is connected to the core 1.1 of the glow element 1 in an electrically conducting manner. The contact element 3 can be formed from one piece together with a connector pin 3.1 of the heating rod, which protrudes from the rear end of the sheath 2. An insulator 4, e.g., a ring or a sleeve, surrounds the connector pin 3.1 and electrically insulates the contact element 3 from the sheath 2. A gasket 5, preferably made of metal (e.g., of copper or brass) may be located between the insulator 4 and the contact element 3, for example on a shoulder 3.2 of the contact element 3. A gasket for sealing also may be arranged between glow element 1 and sheath 2, in particular at the end stop 1.5. The sheath 2 is closed at its rear end by a beading 2.1.

Figure 6:
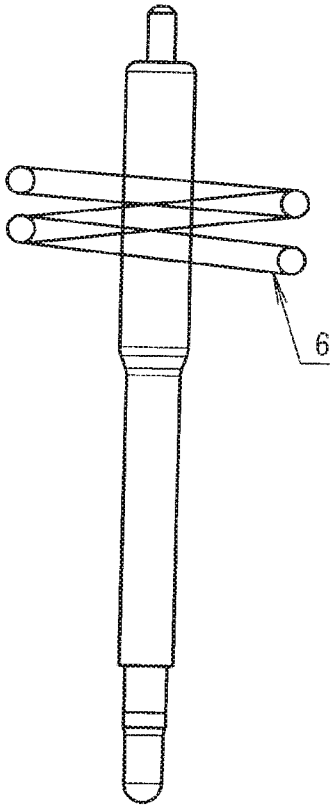
FIG. 6 is a schematic representation of a production step for the heating rod shown in FIG. 3.

The contact element 3 is pressed against the glow element 1 inside the heating rod under pre-tension, more precisely, it is pressed against the connector portion 1.6 of the glow element 1. In this manner, a reliable electrical contact is made between the glow element 1 and the contact element 3 without the use of solder. Using the FIGS. 6 to 8, an example of how to achieve this pre-tension is explained in the following.

First, the glow element 1 is inserted into the sheath 2 and the contact element 3 is pushed onto the connector portion 1.6 of the glow element 1. Then the insulator 4 and, optionally, the gasket 5, are placed upon the contact element 3 and the sheath 2 is closed at its rear end, for example by beading. As shown schematically in FIG. 6, the heating rod and/or the sheath 2 then are heated in this state, or at least heated partially, using a heating unit 6, for example an induction loop.

Figure 7:
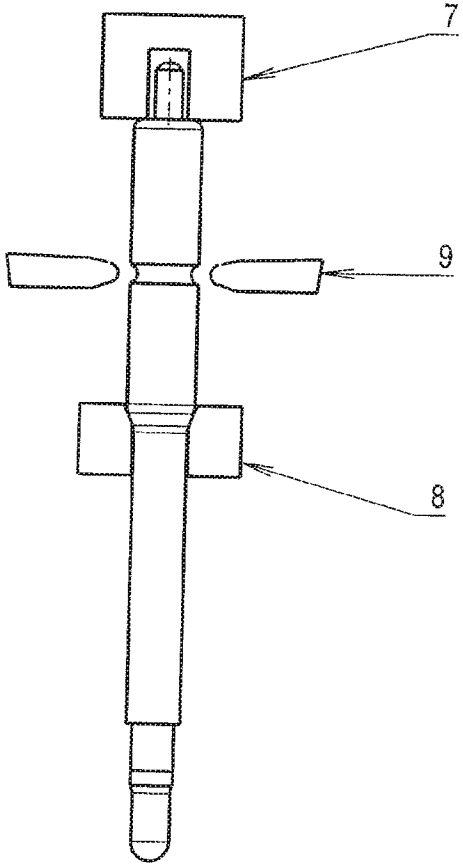
FIG. 7 is a schematic representation of another production step for the heating rod shown in FIG. 3.

In its heated state, the sheath 2 then is compressed in the axial direction, for example with the punches 7, 8, as shown schematically in FIG. 7. During the cooling process, an axial tensile stress is then created in the sheath 2. This tensile stress results in axial pressure onto the contact element 3 and thus a pre-tension, which presses the contact element 3 against the glow element 1. The area intended to be compressed in a longitudinal direction can be limited in a targeted manner by providing an indentation or a reduction in wall thickness at this location, thereby reducing the longitudinal rigidity.

Figure 8:
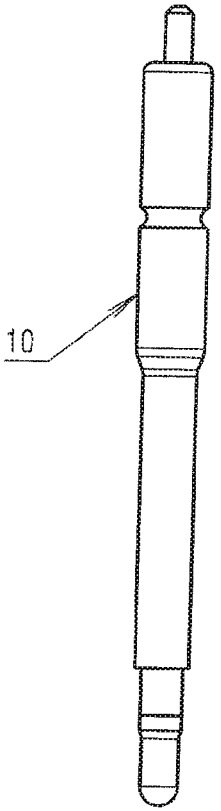
FIG. 8 is a schematic representation of the finished glow plug.

Alternatively or additionally, an axial pre-tension also can be created and/or increased by pressing a circumferential indentation 2.2 into the heated section of the sheath 2 with a tool 9. FIG. 8 shows the finished heating rod 10, in which the contact element 3 then is pressed against the glow element 1 under axial pre-tension.

The pressure created by the axial pre-tension, which presses the contact element 3 and the glow element 1 against each other, must be absorbed in the sheath 2. On the one hand, the pressure is absorbed by the closed end of the sheath 2, on the other hand it is absorbed by the interior surface of the sheath 2, against which an end stop 1.5 of the glow element 1 is pressed, as shown in FIG. 5. FIG. 5 shows a detailed view B of FIG. 3.

The end stop 1.5 is formed by a section of the glow element 1, which increases in diameter from its front end to its rear end inside the sheath, i.e., increases in diameter toward the connector portion 1.6. The axial pre-tension presses the end stop 1.5 against an interior surface of a section of the sheath 2, said section being in the shape of a truncated cone. In front of this section in the shape of a truncated cone, sheath 2 has a cylindrical section; it also has another cylindrical section behind the section in the shape of a truncated cone. The rear cylindrical section has a larger diameter than the front cylindrical section.

The indentation 2.2 is located behind the end stop 1.5 in an axial direction. The indentation 2.2 for example can surround the tapered connector portion 1.6, in particular in front of the contact element 3.

FIG. 4 shows another exemplary embodiment of a heating rod for a glow plug according to FIGS. 1 and 2. This exemplary embodiment differs from the exemplary embodiment shown in FIG. 3 only in the design of the transition 1.7 at the front end of the connector portion 1.6.

Another embodiment (not shown) is designed as described above, but instead of using a separate gasket 5 for sealing, the sheath 2 is coated with sealing material in the area of the end stop, for example with a metal such as copper or brass. The sealing material is then plastically deformed during assembly, thereby sealing a gap between the glow element 1 and the sheath 2.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE NUMBERS

1. Glow element
1.1 Core
1.2 Insulation layer
1.3 Outer conductor
1.4 Surface layer
1.5 End stop
1.6 Connector portion
1.7 Transition
2 Sheath
2.1 Beading
3 Inner pole head
3.1 Contact element
3.2 Shoulder
4 Insulator
5 Gasket
6 Heating unit
7 Punch
8 Punch
9 Tool
10 Heating rod
20 Connector
30 Insulating sleeve
40 Gasket
50 Inner pole
60 Body
70 Joint
80 Joint

What is claimed is:

1. A heating rod for a glow plug, comprising:

a ceramic glow element having a glow tip at its front end, an electrically conductive core, an outer conductor electrically connected with the conductive core at the glow tip, an insulating layer disposed between the conductive core and the outer conductor, and a connector portion at its rear end, the connector portion having a conical shape;

a contact element electrically contacting the connector portion of the glow element, the contact element having a conically shaped receptacle which receives the connector portion of the glow element and is thereby electrically connected to the conductive core of the ceramic glow element, the contact element further including a rearward facing shoulder; and a sheath, the glow element protruding from the front end of the sheath and the rearward facing shoulder of the contact element being disposed within the sheath;

wherein the contact element is pressed against the glow element under pre-tension exerted by the sheath.

2. The heating rod according to claim 1, wherein the glow element includes a section in which an inner diameter of the sheath increases towards the connector portion, thereby forming an end stop, by which the glow element is pressed against an interior surface of the sheath defining the end stop under the pre-tension.

3. The heating rod according to claim 2, wherein the end stop is a surface in the shape of a truncated cone.

4. The heating rod according to claim 2, wherein the sheath includes a front cylindrical section and a rear cylindrical section having a larger inner diameter than the front cylindrical section, wherein a transition section is located between the front cylindrical section and the rear cylindrical section, wherein the end stop of the glow element firmly fits against the interior surface of said transition section.

5. The heating rod according to claim 2, wherein the sheath includes a circumferential indentation located behind the end stop seen in the longitudinal direction of the heating rod wherein the circumferential indentation creates or increases the pre-tension in the sheath.

6. The heating rod according to claim 5, wherein the indentation surrounds the connector portion.

7. The heating rod according to claim 1, wherein the sheath is beaded at its rear end.

8. The heating rod according to claim 1, wherein the contact element makes a solder-free contact with the connector portion of the glow element.

9. A glow plug with a heating rod according to claim 1, comprising a metallic body from which the heating rod protrudes.

10. The heating rod according to claim 1, wherein the contact element includes a connector pin portion having a smaller diameter than the shoulder and which protrudes from a rear end of the sheath.

11. A method for producing a heating rod, comprising:

inserting a ceramic glow element into a sheath, the ceramic glow element having a glow tip at its front end, an electrically conductive core, an outer conductor electrically connected with the conductive core at the glow tip, an insulating layer disposed between the conductive core and outer conductor, and a connector portion at its rear end, the connector portion having a conical shape;

making electrical contact between the conductive core at the connector portion of the glow element and a contact element, the contact element having a conically shaped receptacle which receives the connector portion of the glow element when making electrical contact; and creating a pre-tension in the sheath which presses the contact element against the glow element by heating a section of the sheath and creating a circumferential indentation in the sheath by plastic deformation by pressing a tool into the heated section of the sheath.

12. The method according to claim 11, wherein the connector portion is pushed onto the contact element.

13. The method according to claim 11, wherein an insulator is arranged behind a shoulder of the contact element and the rear end of the sheath, and the rear end of the sheath is beaded.

14. The method according to claim 11, wherein the contact element is clamped between the glow element and the rear end of the sheath or between the glow element and an end cap attached at the rear end of the sheath.

15. The method according to claim 14, wherein, when the section of the sheath is heated, the sheath is also compressed in an axial direction to thereby create or increase the pre-tension.

16. The method according to claim 11, wherein the sheath comprises a front section and a rear section, wherein the front section has a smaller inner diameter than the rear section, whereby the ceramic glow element is pressed against tapering walls of an intermediate section located between the front section and the rear section.

* * * * *